United States Patent [19]

Wells

[11] 4,424,955

[45] Jan. 10, 1984

[54] APPARATUS FOR TREATING LIQUID METAL IN A VESSEL

[75] Inventor: William Wells, Charlotte, N.C.

[73] Assignee: Korf Technologies, Inc., Charlotte, N.C.

[21] Appl. No.: 308,701

[22] Filed: Oct. 5, 1981

[51] Int. Cl.[3] ..... C21C 5/42

[52] U.S. Cl. ..... 266/44; 75/59; 75/60; 266/47; 266/243

[58] Field of Search ..... 266/44, 243–246; 75/59, 60

[56] References Cited

U.S. PATENT DOCUMENTS 4,222,553 9/1980 Edamoto ..... 266/266

4,330,108 5/1982 Nakanishi ..... 266/47

*Primary Examiner*—Peter D. Rosenberg

*Attorney, Agent, or Firm*—Ralph H. Dougherty

[57] ABSTRACT

A method and apparatus for treating molten metal in a bottom pour vessel through a pouring opening controlled by a slidable gate closure member. A dual concentric tuyere having a central conduit and an outer annular conduit is positioned in the pouring opening of the vessel. Treating material is injected into the molten metal through the central conduit of the tuyere and a coolant is passed through the outer annular conduit of the tuyere. After completion of the treatment, oxygen is blown through both the central conduit and the annular conduit to burn back the tuyere, opening the nozzle well for pouring.

7 Claims, 3 Drawing Figures

APPARATUS FOR TREATING LIQUID METAL IN A VESSEL

BACKGROUND OF THE INVENTION

The present invention relates to the treating of liquid metal in a refining or holding vessel by injection of gas through the pouring outlet in the bottom wall of the vessel, which outlet is controlled by a slidable gate closure mechanism. This invention is particularly applicable to the refining of steel in a ladle or other holding vessel.

It is known that various metal refining treatments may be carried out in a vessel by the underbath injection of a gas through the side wall or bottom wall of the vessel. Such treatments include desulfurizing, dephosphorizing, deoxidation, and making alloy additions. Heretofore, however, any required piping remained with the vessel and was not detachable therefrom upon completion of the metallurgical treatment.

A common method of injecting a treating gas into a liquid metal bath is through a porous plug in the bottom wall of the vessel. Gas will pass through the interstices of the porous plug into the bath, but molten metal will not pass through the plug. Very high pressures are required to force sufficient quantities of gas through the plug to accomplish the desired treatment. The present invention avoids the problems inherent in the use of porous plugs.

SUMMARY OF THE INVENTION

The present invention is a removable underbath tuyere for injection of treating gases through the pouring opening of a ladle or vessel which opening is controlled by a slidable gate closure mechanism. The tuyere or blowing nozzle is a dual concentric pipe, the central passageway of which is adapted for blowing a treating material therethrough, and the outer annular passageway of which is adapted for blowing a coolant therethrough to prevent deterioration of the pipe during the treating period. The tuyere extends through the pouring opening in the slidable gate, and is anchored in a refractory tuyere block fixed in the nozzle well.

Upon completion of the metallurgical treatment the tuyere and a portion of the tuyere block are removed from the nozzle well leaving a pouring opening controllable by the slidable gate.

Suitable slidable gate closure mechanisms are shown in Shapland U.S. Pat. No. 3,501,068.

OBJECTS OF THE INVENTION

It is a principal object of this invention to provide a means for metallurgically treating molten metal by injection of solids, fluids or gases into the metal, whereby the injected material will act upon the molten metal with maximum effect.

It is another object of this invention to provide apparatus for metallurgically treating molten metal in a vessel or ladle by the injection of a gas through a pouring opening, which will allow the pouring of the molten metal through the pouring opening after completion of the metallurgical treatment.

It is another object to provide a method for the gaseous treatment of a molten metal in a ladle or vessel whereby gas is injected into the molten metal beneath the surface of the metal through the pouring opening, followed by pouring of the molten metal through the same opening.

It is also an object of this invention to provide a means for removal of an underbath injection device while molten metal remains in the container without any loss of molten metal.

BRIEF DESCRIPTION OF THE DRAWINGS

This invention is better understood by referring to the following detailed description and the appended drawings, in which.

DETAILED DESCRIPTION

Figure 1:
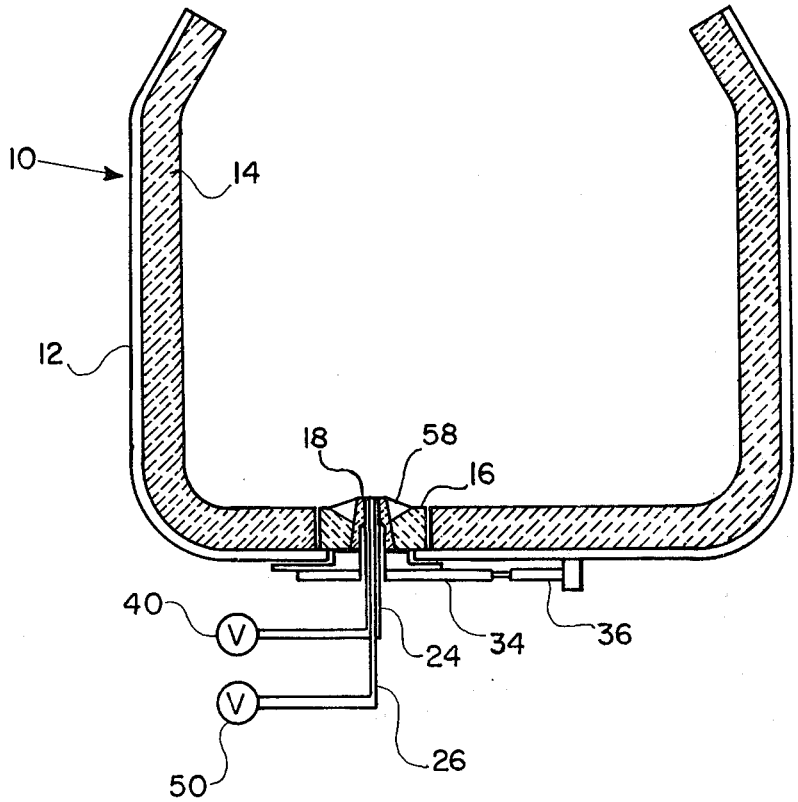
FIG. 1 is a vertical cross-section of a hot metal vessel taken through the pouring opening and showing the gas injection apparatus in place.
Figure 2:
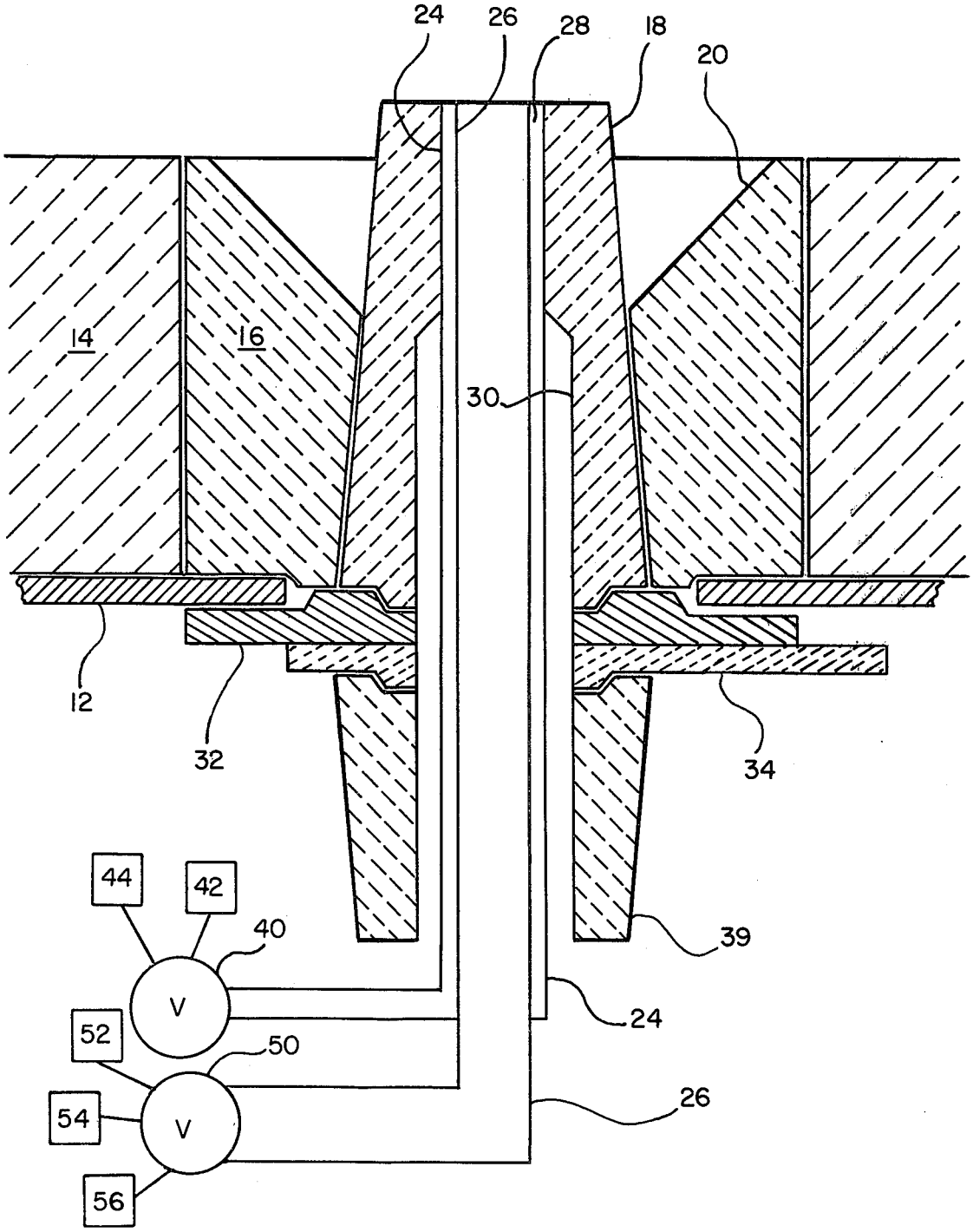
FIG. 2 is a vertical cross-section of a portion of FIG. 1 on a larger scale.
Figure 3:
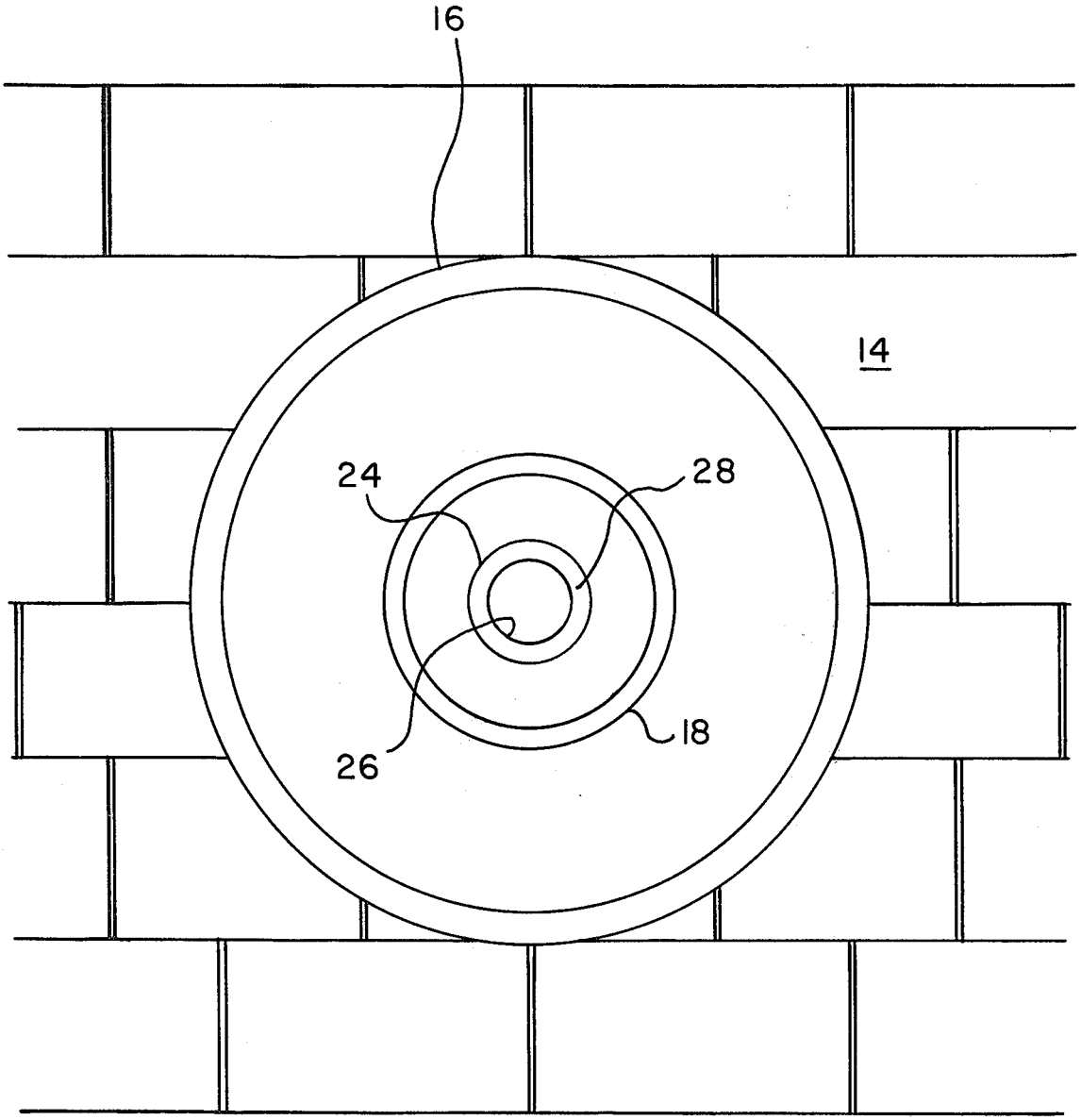
FIG. 3 is a plan view of a portion of the vessel depicted in FIG. 2 showing the nozzle well and gas injection apparatus.

As shown in FIG. 1, vessel or ladle 10 having a steel shell 12 is lined with refractory 14 and has a pouring opening in its bottom wall. Situated within the pouring opening is a nozzle block 16 which is made of a dense, wear-resistant refractory. Central to the nozzle block is a vertical opening in which a refractory tuyere block 18 is positioned. Both the nozzle block 16 and the tuyere block 18 are held in position by a mortar. The nozzle block 16 is preferably tapered downwardly at surface 20 toward the pouring opening. Tuyere block 18 has a central orifice in which a central dual concentric tuyere is situated. The tuyere consists of an outer metal pipe 24 and an inner or central metal pipe 26 spaced from the outer pipe by any convenient spacing means to form an annular space 28 between the pipes. The lower interior portion of tuyere block 18 is preferably provided with an internal relief indicated at 30, which begins in the region of intersection of the extended line of the tapered surface 20 with the center of the tuyere block. A fixed refractory retaining plate 32 engages the bottom of the tuyere block 18 to hold it in the operative position.

A slidable gate closure mechanism affixed beneath the pouring opening consists of a slidable refractory plate 34 having an open position and a closed position, means for operating the gate such as a pneumatic or hydraulic cylinder 36 attached to plate 34, and suitable supporting means, not shown. Optionally, a pouring nozzle 39 may be attached to the bottom of the sliding gate to minimize splash and spatter during the pouring operation.

Valve 40 connects outer tuyere pipe 24 to an external source of coolant 42, and alternatively to an external source of oxygen 44. Central tuyere pipe 26 is connected through valve 50 to oxygen source 52, to a source of inert gas 54, and to the source 56 of treating material. The treating material can be a solid addition in a carrier gas, a liquid or any desired treating gas.

The outer tuyere pipe 24 is tightly cemented into the tuyere block 18 only at the top where there is no inner relief.

In operation the nozzle block 16 is rammed into place in the vessel lining 14 while the vessel is cold. The vessel is then heated to operating temperature by using conventional vessel preheaters, after which the tuyere block 18 containing the tuyere pipes 24 and 26 is placed into the nozzle brick and cemented into place from the bottom of the vessel. The refractory support plate 32 is fastened into position to retain the tuyere block in the blowing position, after which the sliding gate closure apparatus is installed. If desired, a moldable refractory such as gunnite can be placed in region 58 around the tip of the tuyere block within the furnace. The pipes 24 and 26 are connected to the sources of gas supply, flow of a cooling gas from source 42 is initiated through annulus 28. Inert gas from source 54 is started through the central tuyere pipe 26, then liquid metal is poured into the vessel. Once the metal in the vessel reaches the required level, approximately 70% of the full level, then the gas treatment commences. Normally oxygen will be blown through the central pipe and cooling gas through the outer annulus. At the end of the treatment oxygen is fed through both the central pipe 26 and the annular space 28. The oxygen reacts with the hot metal to burn the pipes back into the tuyere block and along with it the tip of the refractory tuyere block. When the tuyere block is burnt back as far as the annular relief 30, tuyere pipes 24 and 26 are no longer connected to the tuyere block 18, whereupon they are withdrawn and the sliding gate 34 is activated to close the pouring nozzle. At this time the vessel is ready for further handling or treatment, such as vacuum degassing, decanting, transport, or casting.

The following is an example of making stainless steel in a ladle utilizing the above-described invention. In this case, the refractory lining of the ladle was magnesite containing in excess of 95% MgO. The nozzle block and the tuyere block were also made of plus 95% MgO magnesite. Tuyere pipes 24 and 26 were made of low-carbon steel. The cooling gas from source 42 was carbon dioxide and the treating gas from source 56 was an oxygen-carbon dioxide mixture. Sixteen tons of liquid steel containing 20% chromium,8% nickel and 1.3% carbon were poured into the ladle, which had the invented apparatus situated in its pouring nozzle. The oxygen-carbon dioxide mixture was blown into the molten metal for sixty minutes, followed by an inert gas/$O_2$ mixture for a short period, after which time the carbon content had been reduced to 0.005%. A mixture of finely divided lime and fluorspar was then injected into the molten metal along with oxygen to desulfurize and dephosphorize the metal. Oxygen alone was then blown through both the central pipe 26 and the annular space 28 to burn back the tuyere pipes and tuyere block to recess 30. The tuyere pipes were removed and the slide gate 34 was immediately closed. The ladle was then transported to a vacuum degassing station after which the steel was cast into ingots. The resulting steel was a chromium-containing stainless steel having a composition of 18 chrome, 8 nickel stainless steel.

SUMMARY OF THE ACHIEVEMENT OF THE OBJECTS OF THE INVENTION

From the foregoing, it is readily apparent that the present invention provides a method and apparatus for metallurgically treating molten metal in a refining or holding vessel by injection of treating material through the sub-surface pouring nozzle.

What is claimed is:

1. Apparatus for injecting a treating gas into a vessel through its bottom wall, said vessel having a refractory lining with a bottom-pour opening therein, said apparatus comprising:

a refractory nozzle block mortared into said refractory lining and having a central opening aligned with the axis of pour;

a refractory tuyere block positioned in the central opening in said nozzle block and extending into said vessel at least to the limit of the refractory lining;

dual concentric pipes fixed within said tuyere block and terminating at the end of said tuyere block within the furnace, said pipes having an annular passageway therebetween and extending beyond the outer steel shell of the furnace and being connected to respective sources of treating material; and a slidable gate closure member fastened external to said vessel and having a refractory closure member with a pouring opening being aligned with the external portion of said dual concentric pipes to allow said pipes to project therethrough.

2. Apparatus according to claim 1 wherein said tuyere block has an internal relief extending from the bottom of said tuyere block approximately half way to the upper end of said tuyere block.

3. Apparatus according to claim 1 wherein said nozzle block has an interior taper, tapering downwardly from the outer edge of the upper surface of the nozzle block.

4. Apparatus according to claim 1 further comprising a refractory retaining plate beneath said nozzle block and said tuyere block for maintaining both of said blocks in a fixed position.

5. Apparatus according to claim 1 further comprising a downwardly extending nozzle attached to the bottom of said slidable gate closure member.

6. Apparatus according to claim 1 further comprising multiple sources of treating material selectively communicating with the central passageway of said dual concentric pipes.

7. Apparatus according to claim 1 further comprising multiple sources of gas selectively communicating with the annular passageway between said dual concentric pipes.

* * * * *